US007837044B2

(12) United States Patent
Whitty

(10) Patent No.: US 7,837,044 B2
(45) Date of Patent: Nov. 23, 2010

(54) APPARATUS FOR STORING AND DISPENSING A PLURALITY OF BOXES

(76) Inventor: Larry J. Whitty, 3949 Forest Grove Dr., Bettendorf, IA (US) 52722

( * ) Notice: Subject to any disclaimer, the term of this patent is extended or adjusted under 35 U.S.C. 154(b) by 726 days.

(21) Appl. No.: 11/716,836

(22) Filed: Mar. 12, 2007

(65) Prior Publication Data

US 2008/0224577 A1 Sep. 18, 2008

(51) Int. Cl.
*A47F 5/08* (2006.01)

(52) U.S. Cl. ..... 211/106; 211/59.2; 211/181.1; 312/42

(58) Field of Classification Search ..... 211/133.2, 211/133.5, 195, 106, 87.01, 181.1, 90.03, 211/119, 49.1, 59.2, 85.31; 312/35, 42, 45, 312/50, 72, 73, 290; 221/281, 306, 309
See application file for complete search history.

(56) References Cited

U.S. PATENT DOCUMENTS

| | | | | | |
|---|---|---|---|---|---|
| 849,590 | A | * | 4/1907 | Bailey | 312/42 |
| 1,520,970 | A | * | 12/1924 | Smith | 211/59.2 |
| 2,723,036 | A | * | 11/1955 | Temple | 211/59.2 |
| 2,805,111 | A | * | 9/1957 | Jarnot | 312/42 |
| 2,994,441 | A | * | 8/1961 | Browning, Jr. | 211/189 |
| 3,225,939 | A | * | 12/1965 | Braun | 211/186 |
| 3,744,866 | A | | 7/1973 | Cook | |
| 3,938,666 | A | | 2/1976 | Castleberry | |
| 4,015,885 | A | * | 4/1977 | Baggaley | 312/42 |
| 4,037,756 | A | * | 7/1977 | Jaquish | 221/242 |
| 4,146,278 | A | * | 3/1979 | Seitel | 312/35 |
| 4,597,614 | A | * | 7/1986 | Alexander | 312/42 |
| 4,850,511 | A | * | 7/1989 | Kral et al. | 221/154 |
| 5,135,135 | A | * | 8/1992 | Olivier | 221/281 |
| 5,257,702 | A | * | 11/1993 | Grafstein | 211/106 |
| 5,328,258 | A | | 7/1994 | Scalise | |
| 2004/0188365 | A1 | | 9/2004 | Forte | |

FOREIGN PATENT DOCUMENTS

| | | | | |
|---|---|---|---|---|
| EP | 277830 | * | 8/1988 | 211/49.1 |
| FR | 2651955 | * | 3/1991 | 211/181.1 |

* cited by examiner

*Primary Examiner*—Hanh V Tran
(74) *Attorney, Agent, or Firm*—Pauley Petersen & Erickson

(57) ABSTRACT

The apparatus includes first and second side walls, and a bottom wall having a first, a second, a third and a fourth side edge. A lower edge of the first side wall is secured to the first side edge, and a lower edge of the second side wall is secured to the third side edge. A door is rotatably coupled to a front edge of the first side wall and latchable proximate to a front edge of the second side wall. When latched, a bottom edge of the door is located at a pre-determined distance from the second side edge of the bottom wall. The first and second side walls, the bottom wall and the door form a substantially rectangular enclosure when first and second cross-members, fixedly attached to respective top and bottom back edges of the first and second side walls, are affixed to a vertical structure.

13 Claims, 9 Drawing Sheets

APPARATUS FOR STORING AND DISPENSING A PLURALITY OF BOXES

CROSS-REFERENCE TO RELATED APPLICATIONS

None

BACKGROUND OF THE INVENTION

The present invention generally relates to box storage and dispensing, and more specifically, to an apparatus for storing and dispensing a plurality of pizza boxes.

Many businesses require storage and dispensing of boxes. For example, when working in a pizza kitchen, storage of the boxes necessary to package the pizzas has been problematic. Often times, the pizza boxes are not close at hand when needed. In some cases, the pizza boxes are loosely stacked on floors or countertops and are therefore to prone to unintended contamination by food items such as pizza sauce, cheese, etc. In other cases, traditional cabinets are used to house the pizza boxes. Such cabinets are heavy, difficult to clean, cumbersome, expensive, and are not easily wall mountable.

SUMMARY OF THE INVENTION

In general, a lightweight and easily mountable apparatus for storing a number of boxes is disclosed. In addition to storing, the apparatus may be optionally configured with a tilted wall to enable easy dispensing of one box at a time through a box dispensing opening in the front of the apparatus. Further, although illustrated as an assembled pizza box holder in the following figures, the apparatus for storing and dispensing boxes is easily collapsible for compact storage and shipping. While described in terms of a pizza boxes, it is contemplated the apparatus for storing and dispensing boxes can be used to store stacks of other types of boxes, for example shipping boxes.

In one embodiment, an apparatus for storing and dispensing a number of boxes includes a first side wall, a second side wall, and a bottom wall. The bottom wall includes a first, a second, a third and a fourth side edge. A lower edge of the first side wall is secured to the first side edge, and a lower edge of the second side wall is secured to the third side edge. The apparatus for storing and dispensing a number of boxes also includes a door rotatably coupled to a front edge of the first side wall and latchable proximate to a front edge of the second side wall. A bottom edge of the door is substantially parallel to and located at a pre-determined distance from the second side edge of the bottom wall when the door is latched. The pre-determined distance is based on the height of the boxes to be stored and dispensed by the apparatus for storing and dispending the number of boxes. The apparatus for storing and dispensing a number of boxes further includes a first and second cross-member. The first cross-member is fixedly attached to a top back edge of each of the first and second side walls in order to position the second side wall substantially parallel to the first side wall. The second cross-member is fixedly attached to a bottom back edge of each of the first and second side walls. The first side wall, the second side wall, the bottom wall and the door are constructed of a wire grid and form a substantially rectangular enclosure having a top opening and is sized to receive the boxes when the first and second cross-members are affixed to a vertical structure, for example to a restaurant kitchen wall.

In another embodiment, an apparatus for storing and dispensing a number of stacked pizza boxes includes a first side wall, a second side wall, and a bottom wall. The bottom wall includes a first, a second, a third and a fourth side edge. A lower edge of the first side wall is secured to the first side edge, and a lower edge of the second side wall is secured to the third side edge to position the second side wall substantially parallel to the first side wall. The apparatus for storing and dispensing the plurality of pizza boxes also includes a door rotatably coupled to a front edge of the first side wall and latchable proximate to a front edge of the second side wall. A bottom edge of the door is located at a pre-determined distance from the second edge of the bottom wall in order to define a box dispensing opening when the door is latched. Further included are first and second cross-members, and a box guide wall. The first cross-member is fixedly attached to a top back edge of each of the first and second side walls, and affixed to a vertical structure. The second cross-member is fixedly attached to a bottom back edge of each of the first and second side walls, and affixed to the vertical structure. The box guide wall is tiltedly positioned proximate to the fourth side edge of the bottom wall and configured to urge a lowermost pizza box of the stacked pizza boxes through the box dispensing opening.

In a further embodiment, an apparatus for storing and dispensing a number of stacked boxes includes a first side wall, a second side wall and a bottom wall. The bottom wall includes a first, a second, a third and a fourth side edge. A lower edge of the first side wall is secured to the first side edge of the bottom wall and a lower edge of the second side wall is secured to the third side edge of the bottom wall. The apparatus for storing and dispensing a number of stacked boxes also includes a first door rotatably coupled to a front edge of the first side wall and latchable proximate to a front edge of the second side wall. A bottom edge of the door is substantially parallel to and located at a pre-determined distance from the second side edge of the bottom wall when the door is latched. The pre-determined distance is based on the height of one of the boxes to be stored and dispensed by the apparatus. The apparatus for storing and dispensing a number of stacked boxes further includes a back wall having a first side edge and a second side edge parallel to the first side edge of the back wall. The first side edge of the back wall is coupled to a back edge of the first side wall and the second side edge of the back wall is coupled to a back edge of the second side wall. The first side wall, the second side wall, the back wall, the bottom wall and the door form a substantially rectangular enclosure having a top opening and sized to receive a plurality of boxes. The apparatus may additionally include a mounting means for attachment to an overhead structure, and the back wall may be a second door, identically configured as the first door.

It should be understood that the present invention includes a number of different aspects and/or features which may have utility alone or in combination with other aspects or features. Accordingly, this summary is not an exhaustive identification of each such aspect or feature that is now or may hereafter be claimed, but represents an overview of certain aspects of the present invention to assist in understanding the more detailed description that follows. The scope of the invention is not limited to the specific embodiments described below, but is set forth in the claims now or hereafter filed.

DETAILED DESCRIPTION OF THE PREFERRED EMBODIMENTS

As described with reference to the accompanying figures, the preferred embodiments illustrate an apparatus for storing and dispensing a plurality of boxes. While the various embodiments are described as storing and holding pizza boxes, it should be understood that the apparatus for storing and dispensing the plurality of boxes can accommodate one of any number of box types, for example shipping boxes or other suitably proportioned boxes.

Figure 1:
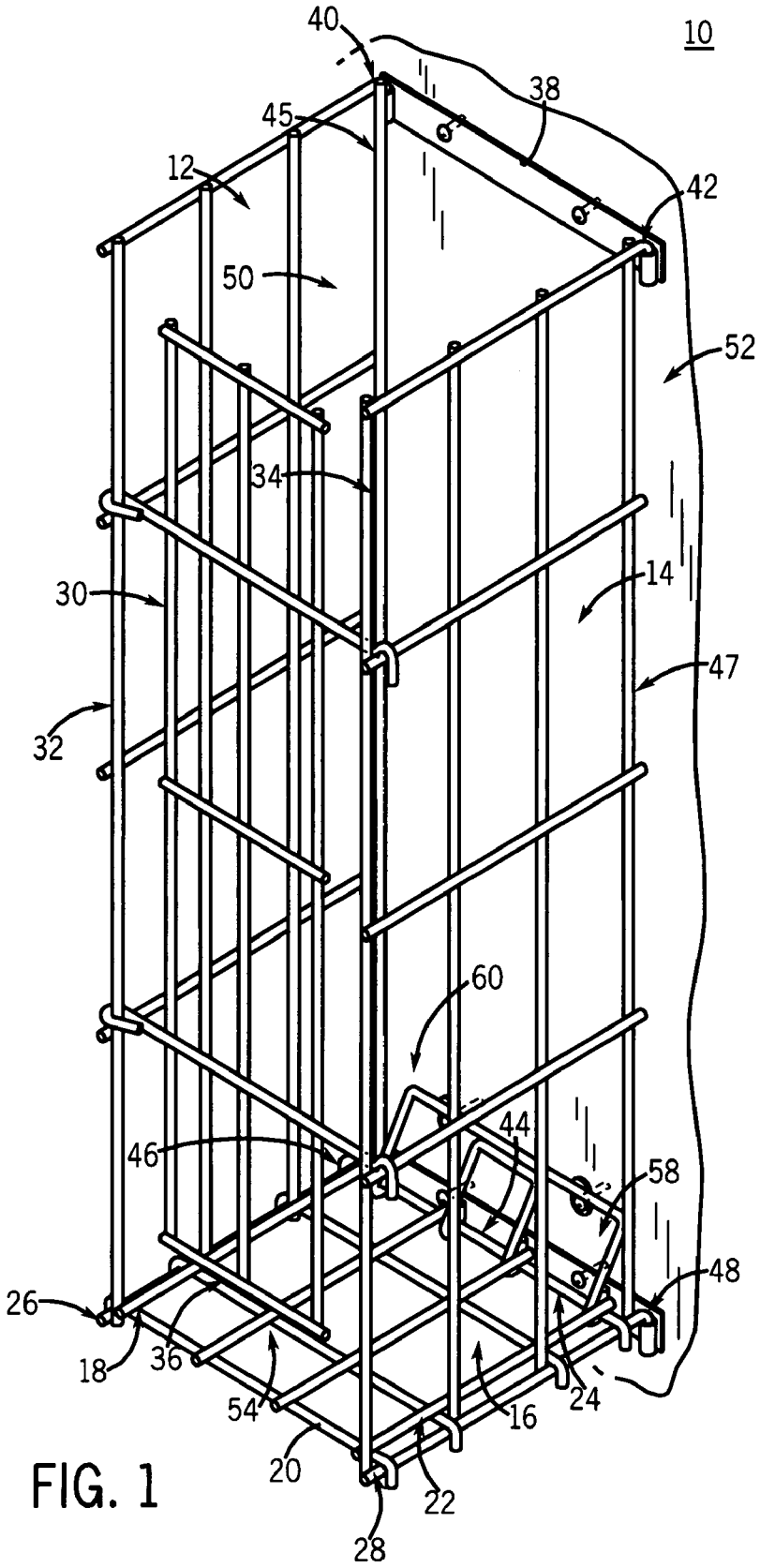
FIG. 1 is a perspective view of an exemplary box holder, according to an embodiment of the invention.

FIG. 1 is a perspective view of an exemplary box holder 10, according to an embodiment of the invention. In the illustrated example, the box holder 10 includes a first side wall 12, a second side wall 14 and a bottom wall 16. A rectangular (or square) footprint size of the bottom wall 16 is commensurate with the size of the boxes intended for storage in, and dispensing from, the box holder 10. The bottom wall includes a first side edge 18, a second side edge 20, a third side edge 22 and a fourth side edge 24. A lower edge 26 of the first side wall 12 is secured to the first side edge 18, and a lower edge 28 of the second side wall 14 is secured to the third side edge 22 of the bottom wall 16.

The box holder 10 also includes a door 30 rotatably coupled to a front edge 32 of the first side wall 12 and latchable proximate to a front edge 34 of the second side wall 14. When the door 30 is latched, a bottom edge 36 of the door 30 is substantially parallel to, and at a pre-determined distance from, the second side edge 20 of the bottom wall 16. The pre-determined distance is based on the height of one of the boxes to be stored and dispensed by the box holder 10.

In one embodiment, the box holder 10 also includes a first and second cross-member 38, 44. One end of the first cross-member 38 is fixedly attached to a top back edge 40 of the first side wall 12, while the other end of the first cross-member 38 is fixedly attached to a top back edge 42 of the second side wall 14. The length of the first cross-member is selected to position the second side wall 14 substantially parallel to the first side wall 12. Likewise, one end of the second cross-member 44 is fixedly attached to a bottom back edge 46 of the first side wall 12, while the other end of the second cross-member 44 is fixedly attached to a bottom back edge 48 of the second side wall 14.

Although illustrated as including two cross-members 38, 44, it is contemplated that the box holder 10 may include more or less cross-members. Further, although illustrated using a hook and eye arrangement (where the hooks are formed in the top back edges 40, 42 and bottom back edges 46, 48 of respective first and second side walls 12, 14 and the eyes are affixed to a front portion of each end of the first and second cross-members 38, 44), it is contemplated that the first and second cross-members 38, 44 may be fixedly attached to the first and second side walls 12, 14 using one of any number of suitable attachment arrangements. Such attachment arrangements may include brackets, clips, and the like.

In another embodiment, the two cross-members 38, 44 may be replaced by a back wall 49 (see, FIG. 2) coupled to back edges 45 and 47 of the first and second sides walls 12, 14, respectively. Inclusion of the back wall 49 rather than the two cross-members 38, 44 enables the box holder 10 to be mounted to, or hung from, an overhead structure such as a ceiling by one of any number of means (e.g., hooks, toggles, screws, brackets, etc.).

As illustrated by FIG. 1, when each of the first and second cross-members 38, 44 are affixed to a vertical structure 52 (e.g., a restaurant kitchen wall), a combination of the first side wall 12, the second side wall 14, the bottom wall 16 and the door 30 (latched) form a substantially rectangular (or square) enclosure having a top opening 50, where the enclosure is sized to store the selected stack of boxes.

The first and second cross-members 38, 44 may be mounted to the vertical structure 52 using one of any number of suitable methods. For example, as illustrated in FIG. 1, a number of apertures formed in each of the first and second cross-members 38, 44 may be suitably sized to receive one or more bolts 53, a fasteners, etc., which when inserted in the apertures and the vertical structure 52, enables mounting of the box holder 10 to the vertical structure 52 (see, FIGS. 5A and 5B). Other mounting methods may include a series mounted hooks designed to slideably receive the first and second cross-members 38, 44, a bolt and slot arrangement, where slots defined in the first and second cross-members are sized to receive a bolt, pre-mounted to the vertical structure 52.

Figure 3:
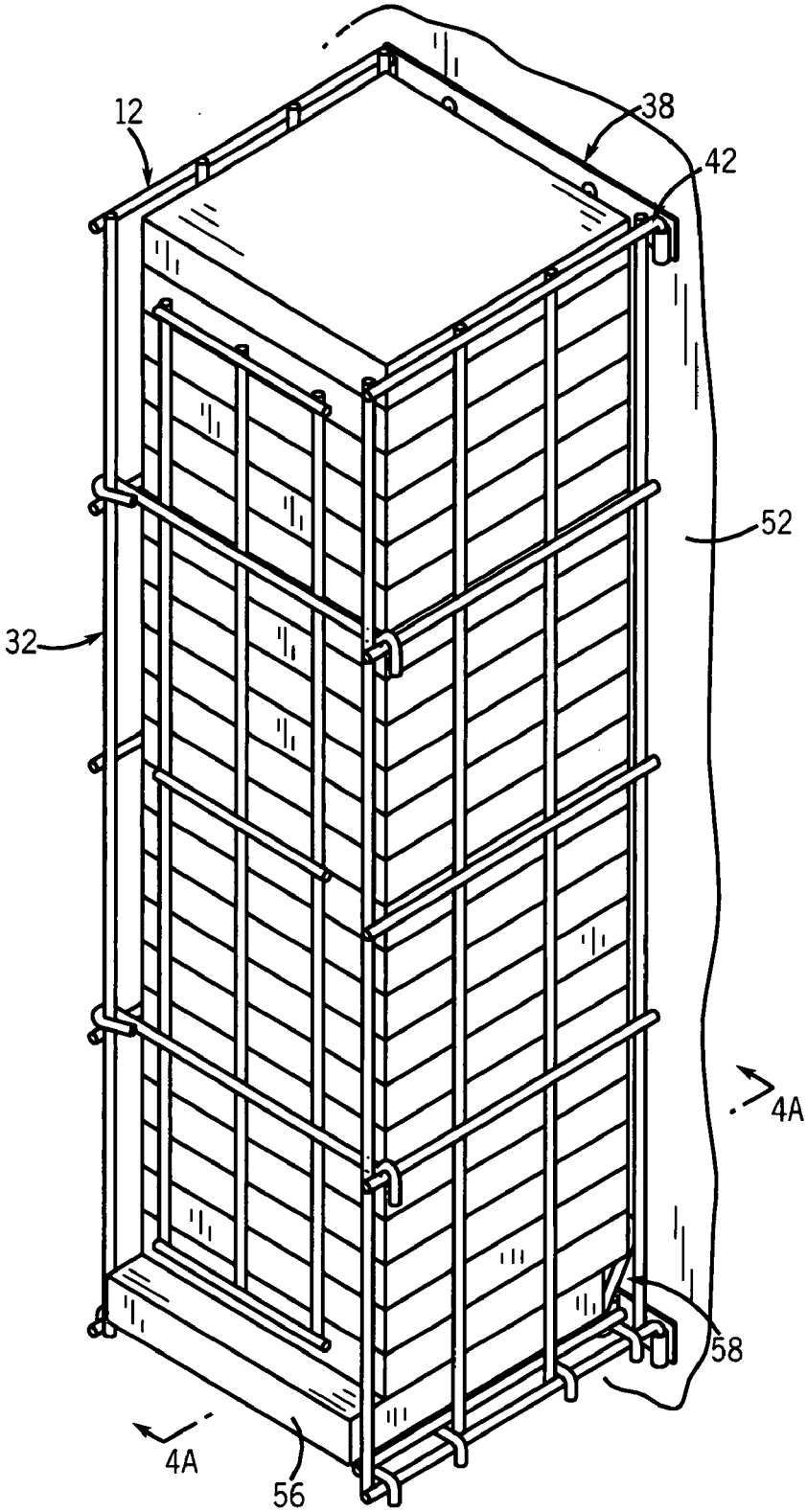
FIG. 3 is a perspective view of the box holder of FIG. 1, including a stack of pizza boxes therein.

FIG. 3 is a perspective view of the box holder 10, loaded with a stack of pizza boxes. Unlike prior art holders, the box holder 10 may be either front loaded with boxes via the door 30, or top loaded with boxes via the top opening 50.

Figure 2:
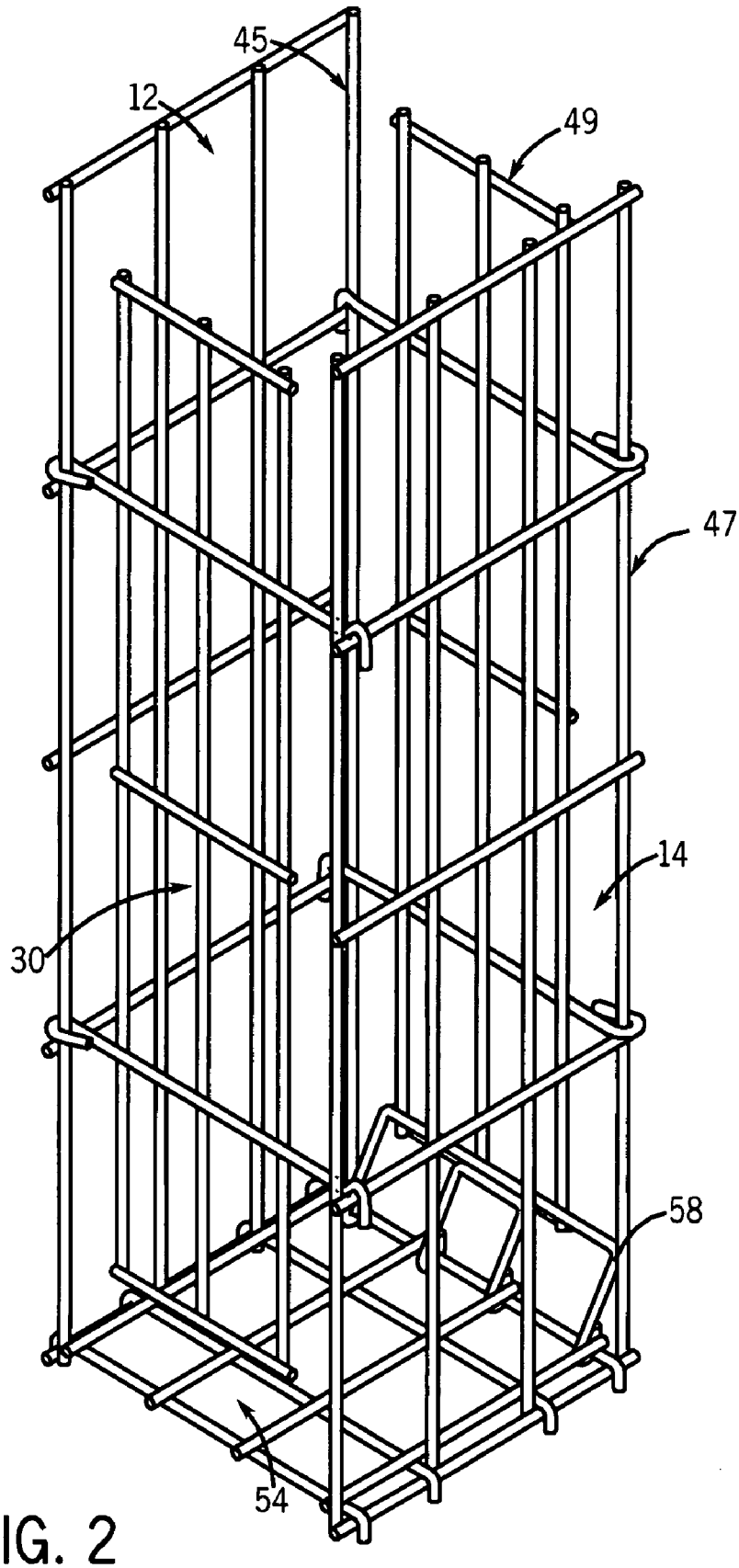
FIG. 2 is a perspective view of another exemplary box holder, according to an embodiment of the invention.

Referring to FIGS. 1-3, the bottom edge 36 of the door 30, the second side edge 20 of the bottom wall 16 and a lower portion of each of the front edges 32, 34 of respective first and second side walls 12, 14 define a box dispensing opening 54 when the door 30 is latched. The box dispensing opening 54 is sized to permit easy access to a single lowermost box of the stack of boxes, for example to a single lowermost pizza box 56.

Figure 4:
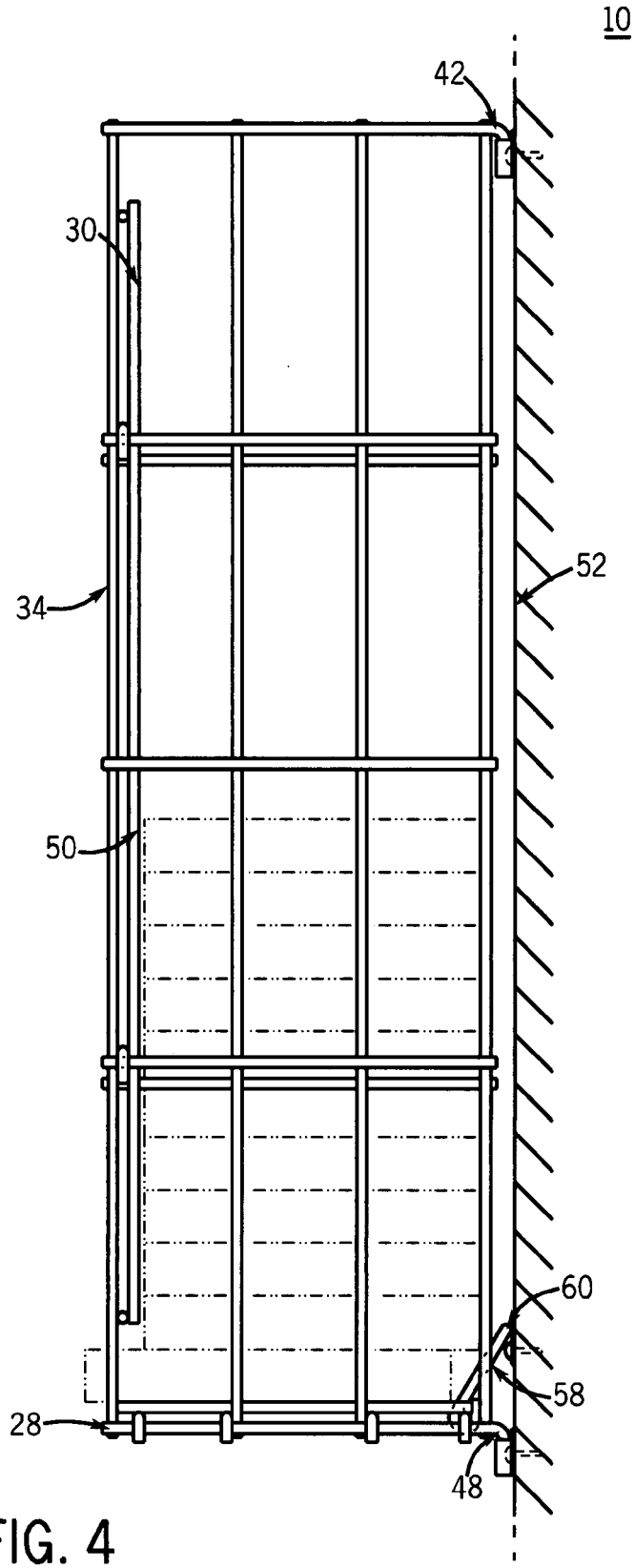
FIG. 4 is a right side view of the box holder of FIG. 1, including a stack of pizza boxes illustrated in shadow.

FIG. 4 is a right side view of the box holder of FIG. 1, including a stack of pizza boxes illustrated in shadow. As shown in FIGS. 1-4, an optional box guide wall 58 is tiltedly positioned proximate to the fourth side edge 24 of the bottom wall 16 such that the lowermost box (e.g., the lowermost pizza box 56) is urged in a forward direction through the box dispensing opening 54. In one embodiment, a lower edge of the box guide wall 58 is rotatably coupled to the fourth side edge 24 of the bottom wall 16, while an upper edge of the box guide wall 58 is affixed to the vertical structure 52 at a location directly above the second cross member 44. The box guide wall 58 is therefore held in a tilted position. While shown as a wire grid, it is contemplated that one of any number of box guide wall designs could be tiltedly positioned for purposes of urging the lowermost box in a forward direction through the box dispensing opening 54.

Figure 5A:
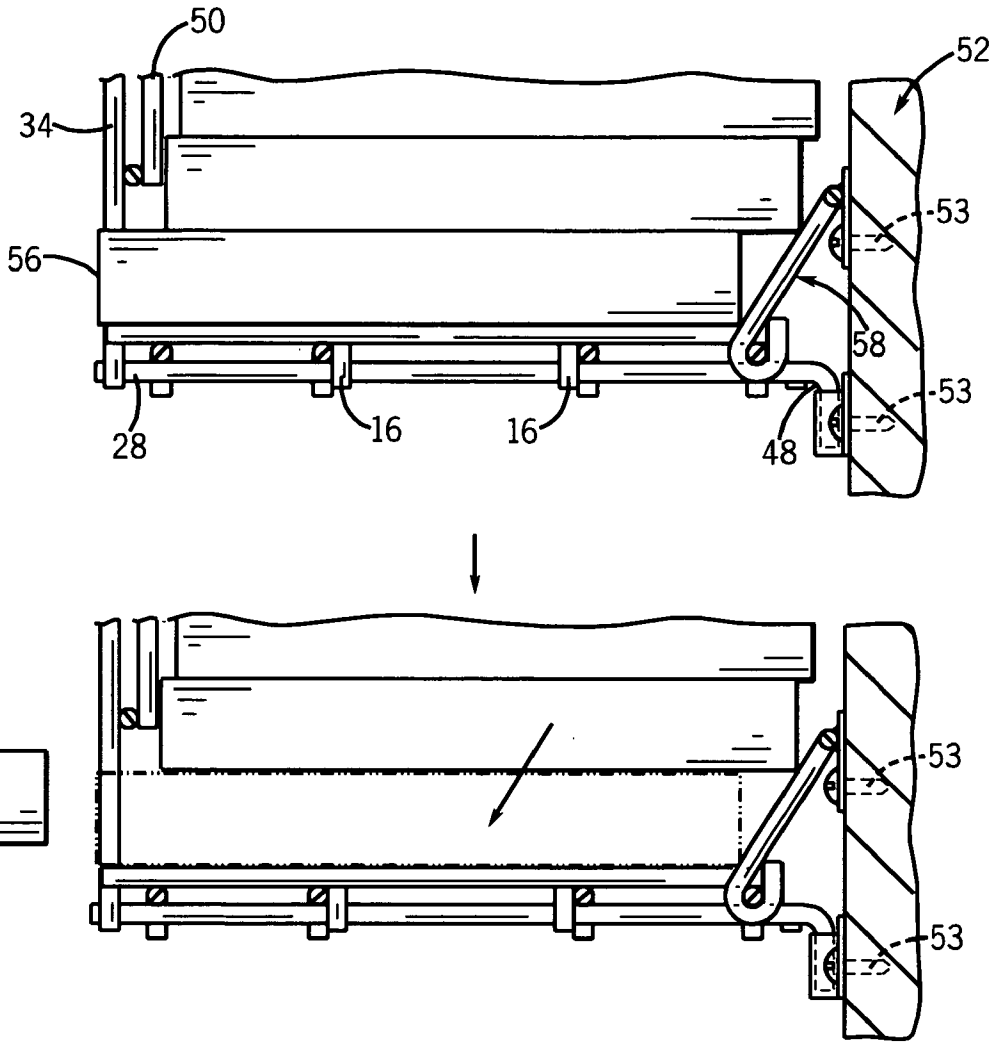
FIGS. 5A and 5B are detailed side views of a bottom portion of the box holder of FIG. 1, showing a lowermost pizza box before and after removal.
Figure 5B:
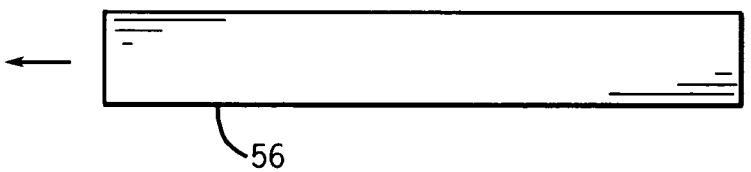

FIGS. 5A and 5B are detailed right side views of a bottom portion of the box holder 10, including the box guide wall 58, showing the lowermost box, in this case, the lowermost pizza box 56, before and after removal. Accordingly, a pizza technician can easily grasp and withdraw the lowermost pizza box 56 through the box dispensing opening 54.

Each of the first side wall 12, the second side wall 14, the bottom wall 16 and the door 30 comprise a respective wire grid arranged as a plurality of vertical and horizontal segments, spaced to form openings therethrough. In the illustrated example, the wire grids of the first and second side walls 14 and 16 are identical, while the wire grid of the bottom wall 16 is slightly larger than its associated box. Additionally, each of the plurality of vertical segments is interiorly situated and wherein each of the plurality of horizontal segments is exteriorly situated. Locating the vertical segments on the inside surface of the box holder 10 ensures that a pizza box (or any suitable box) can move smoothly downward upon removal of the lowermost pizza box 56.

The wire grids may be coated with one of any number of lightweight substances. For example, the wire grids may be epoxy coated, white powder coated, chrome plated, to name a few. The spacing between the horizontal segments of the first side wall 12, the horizontal segments of the second side wall 14, the horizontal segments of the bottom wall 16 and the horizontal segments of the door 30 are selected to minimize the overall weight of the box holder 10 while maintaining the structural integrity of the box holder 10. Similarly, the spacing between the vertical segments of the first side wall 12, the vertical segments of the second side wall 14, the vertical segments of the bottom wall 16 and the vertical segments of the door 30 are similarly selected. The openings created by the spacing between the horizontal and vertical segments also enable easy viewing of the boxes in the box holder 10.

Referring again to FIG. 1, each end of the horizontal segments of the bottom wall 16, parallel to the second side edge 20, include a right-angle bend configured to capture the lower edges 26, 28 of respective first and second side walls 12, 14. The right-angle bend ensures that the bottom wall 16 will be held in place in both the forward-back (by the front and back edges of the first and second side wall 12, 14) and side-to-side (by the lower edges of the first and second side walls 12, 14) directions. The right-angle bend of the horizontal segments of the bottom wall 16 further enhances the collapsibility of the box holder 10 for storage and shipping purposes. Although the right-angle bend is used to capture the lowermost horizontal segment of respective first and second side walls 12, 14, other methods of capture that still permit ease of box holder 10 collapsibility(e.g., a loop at one end and a right angle bend on the other end of the horizontal segments of the bottom wall 16) are contemplated.

Figure 6:
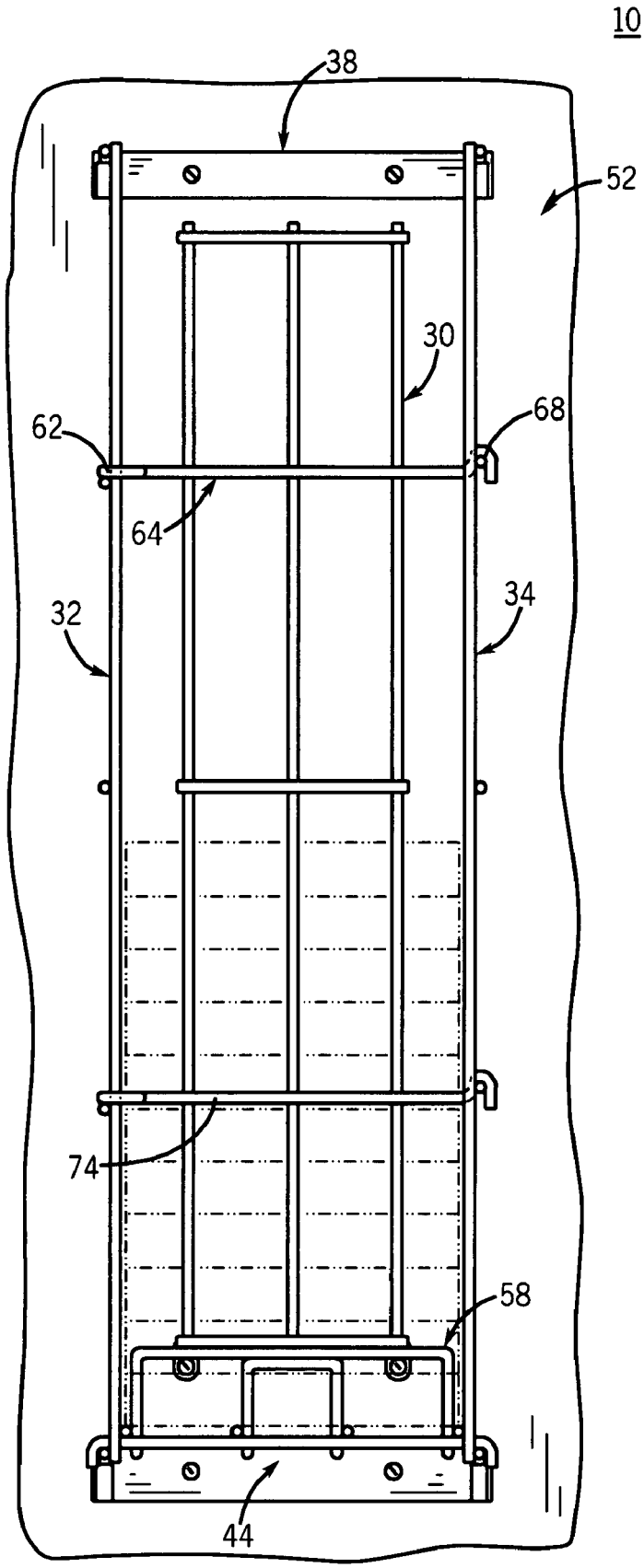
FIG. 6 is a front view of the box holder of FIG. 1, including a stack of pizza boxes illustrated in shadow.

FIG. 6 is a front view of the box holder 10, including a stack of pizza boxes illustrated in shadow. As described above in connection with FIG. 1, the door 30 is rotatably coupled to the front edge 32 of the first side wall 12 and latchable proximate to the front edge 34 of the second side wall 14. In one embodiment, a first end 62 of at least one horizontal segment 64 of the door 30 includes a loop formed therein to rotatably capture the front edge 32 of the first side wall 12. A second end 68 of the horizontal segment 64 of the door 30 includes a hook formed therein to latch immediately behind the vertical segment defining the front edge 34 of the second side wall 14. In the illustrated example of FIG. 5, two latching horizontal segments are included in the door 30 however additional latching horizontal segments 64, 74 may be included, depending on the overall size of the box holder 10.

Figure 9:
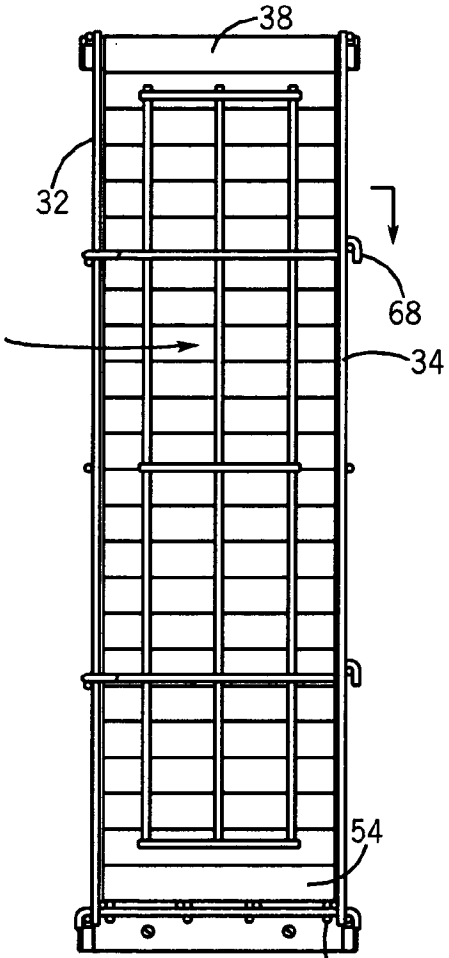
FIGS. 7A, 8 and 9 are a sequence of front views illustrating the steps necessary to front load the box holder of FIG. 1 with a stack of pizza boxes, according to an embodiment of the invention.
Figure 8:
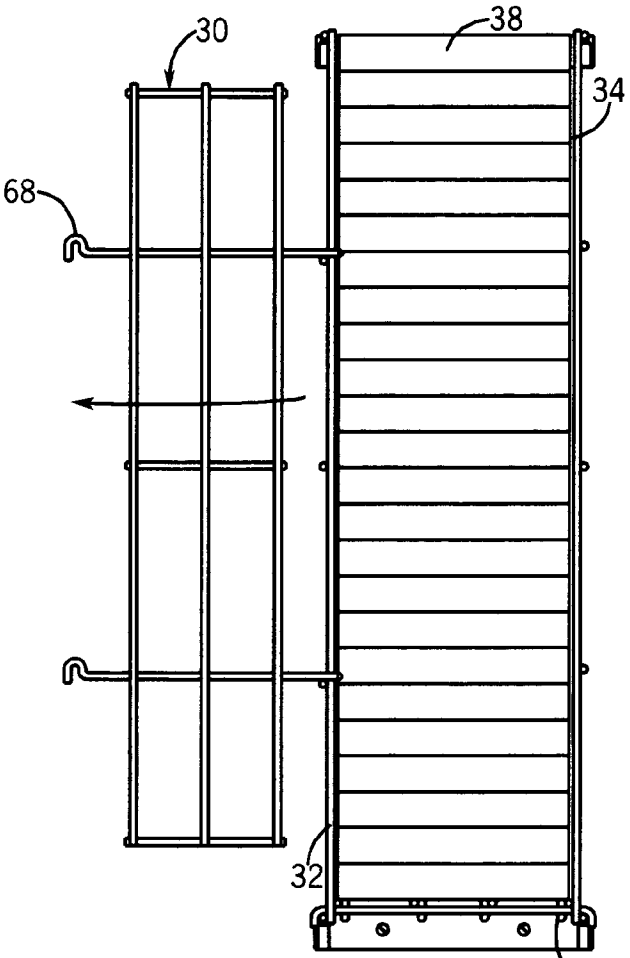
Figure 7A:
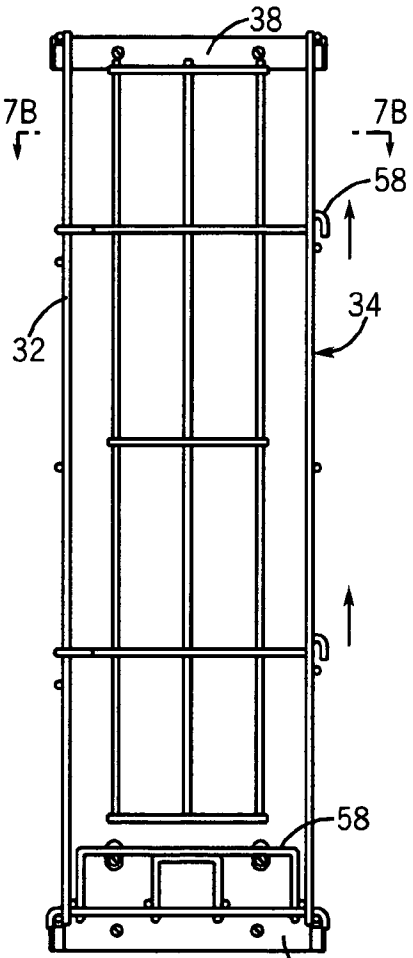

FIGS. 7A, 8 and 9 are a sequence of front views illustrating the steps necessary to front load the box holder 10 with a stack of pizza boxes, according to an embodiment of the invention. Referring to FIG. 7A, a slight upward force applied to the second end 68 of the horizontal segment 64 operates to disengage the hook formed therein from an associated horizontal segment of the second side wall 14. At the same time a slight outward horizontal force applied to the front edge 34 of the second side wall 14 (or a slight horizontal force applied to the second end 68; see, FIGS. 7B and 7C) operates to release the second end 68 from (behind) the front edge 34 of the second side wall 14 Similar forces applied to the second end of additional horizontal latching segments of the door 30, and applied to the front edge 34 of the second side wall 14, will similarly unlatch the door 30 from the second side wall 14.

Figure 7B:
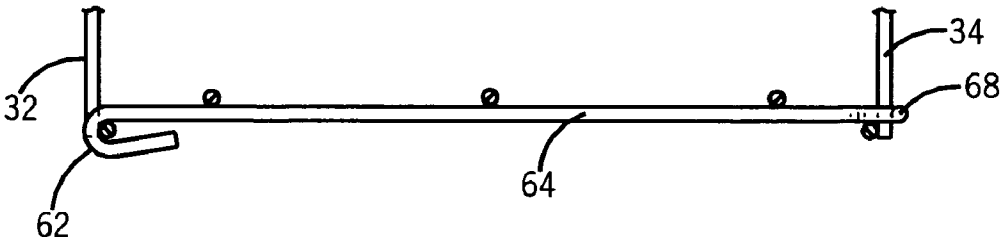
FIG. 7B is a partial cutaway showing a horizontal segment of the door of the box holder of FIG. 1, latched.
Figure 7C:
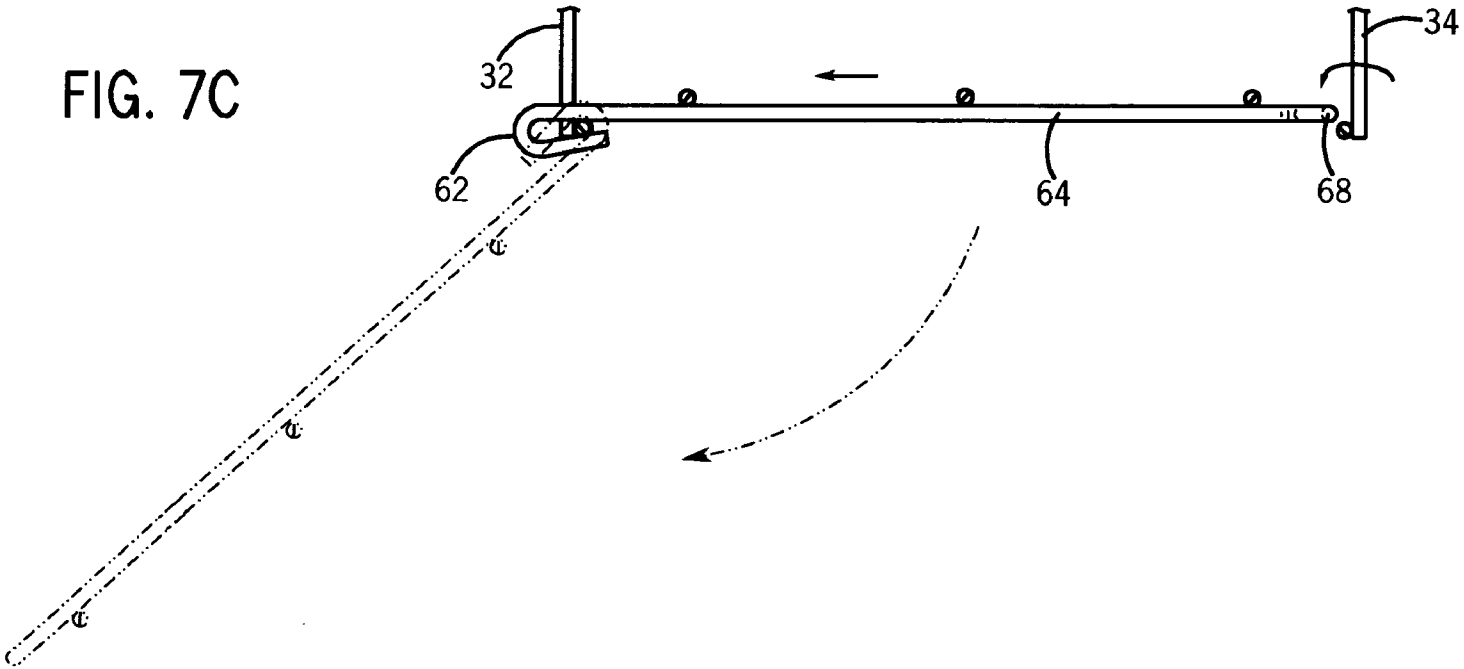
FIG. 7C is a partial cutaway showing a horizontal segment of the door of the box holder of FIG. 1, unlatched.

FIG. 7B is a partial cutaway of the box holder 10 showing the horizontal segment 64 when the door 30 is latched, and FIG. 7C is a partial cutaway of the box holder 10 showing the horizontal segment 64 after the hook formed therein is first disengaged from the associated horizontal segment of the second side wall 14.

As illustrated by FIG. 8, upon unlatching and opening the door 30, a stack of boxes may be front loaded into the box holder 10. When box loading is complete and the door 30 re-latched to its closed position, a user is able to remove the lowermost box with one hand while handling the intended contents of the lowermost box with the other. For example, when pizza box loading is completed and the door 30 is re-latched to its closed position (FIG. 9), a pizza box technician is able to remove the lowermost pizza box 56 from the bottom of the stack via the box dispensing opening 54 with one hand, while handling a pizza in the other. Upon removal of one pizza box, the next pizza box is gravity fed to the bottom of the stack. In this way, a pizza box is always ready for use by the pizza technician. In addition to the time savings for the pizza technician, the design of the box holder 10 enables a hot pizza to be boxed quickly; an advantage for a pizza-eating customer.

Figure 10:
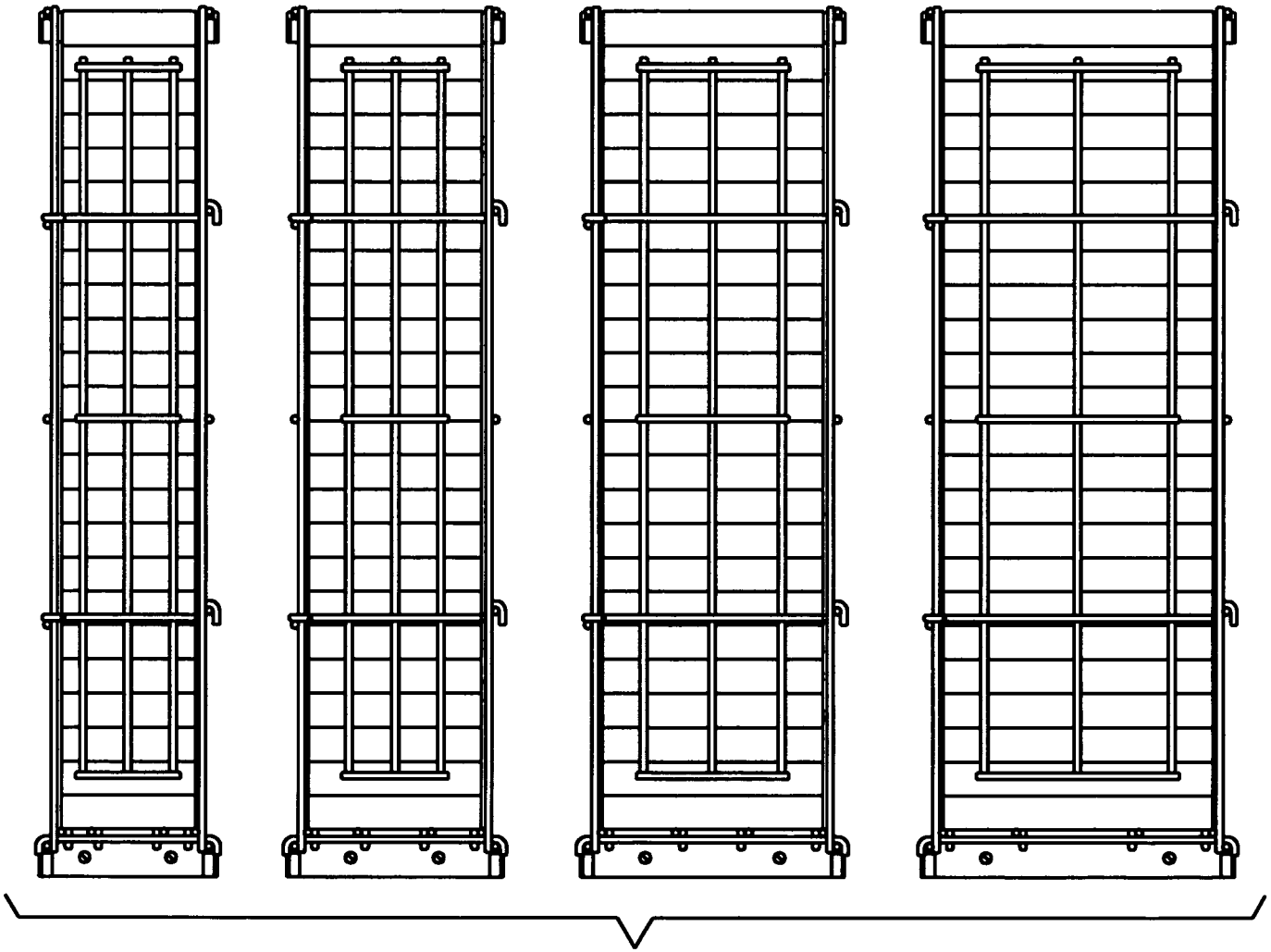
FIG. 10 is a series of four front view examples of different sized pizza box holders, according to an embodiment of the invention.

The box holder 10 can be custom sized. For instance, FIG. 10 provides four front view examples of different sized box holders 10. By varying the size selection of the rectangular (or square) footprint of the bottom wall 16, and proportionally varying the size selection of the first side wall 12, the second side wall 14, and the door 30, the box holder 10 can accommodate one of any number box sizes. For example, an 8"×8"×48" box holder 10 can accommodate a stack of small sized pizza boxes, a 10½"×11"×48" box holder 10 can accommodate a stack of medium sized pizza boxes, a 14"×15½"×48" box holder 10 can accommodate a stack of large sized pizza boxes, and a 17½"×18½"×48" box holder 10 can accommodate a stack of extra-large sized pizza boxes. In addition, a series of same sized or different sized box holders 10 can be side-by-side fastened to each other.

Thus, unlike traditional cabinet-type box holders that may or may not include a number of heavy adjustable vertical walls and cumbersome hardware, the cage-like design of the box holder 10 yields a lightweight box enclosure that is simple to assemble, is sanitary, and permits easy viewing of the stacked boxes for inventory purposes and the like. Additionally, the box holder 10 is easily wall mountable to free-up valuable counter space for others uses, for example, for pizza preparation.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. An apparatus for storing and dispensing a plurality of boxes, comprising:

a first side wall;

a second side wall;

a bottom wall having a first, a second, a third and a fourth side edge, a lower edge of the first side wall secured to the first side edge, and a lower edge of the second side wall secured to the third side edge, wherein each of the first and second side walls comprises a plurality of vertical and horizontal segments spaced to form openings therethrough;

a door rotatably coupled to a front edge of the first side wall and latchable proximate to a front edge of the second side wall, the door including a first end of at least one horizontal segment of the door having a loop formed to rotatably capture a vertical segment defining the front edge of the first side wall, and wherein a second end of the at least one horizontal segment of the door having a hook to latch onto a horizontal segment of the second side wall and immediately behind a vertical segment defining the front edge of the second side wall;

a first cross-member fixedly attached to a top back edge of each of the first and second side walls to position the second side wall substantially parallel to the first side wall; and a second cross-member fixedly attached to a bottom back edge of each of the first and second side walls, the first side wall, the second side wall and the bottom wall forming a substantially rectangular enclosure having a top opening and sized for receiving the plurality of boxes when the first and second cross-members are affixed to a vertical structure.

2. The apparatus of claim 1, wherein a lower portion of each of the front edges of the first and second side wall and the bottom edge of the door located at a pre-determined distance from the second side edge of the bottom wall form a box dispensing opening when the door is latched, the pre-determined distance configured to permit grasping and withdrawal of a lowermost box via the box dispensing opening.

3. The apparatus of claim 2, further comprising a box guide wall tiltedly positioned proximate to the fourth side edge of the bottom wall and configured to urge the lowermost box through the box dispensing opening.

4. The apparatus of claim 1, wherein each of the first side wall, the second side wall, the bottom wall and the door comprises a respective wire grid including said plurality of vertical and horizontal segments spaced to form openings therethrough.

5. The apparatus of claim 4, wherein each of the respective wire grids is white powder coated.

6. The apparatus of claim 4, wherein each of the respective wire grids is chrome plated.

7. The apparatus of claim 4, wherein each of the plurality of vertical segments is interiorly situated and wherein each of the plurality of horizontal segments is exteriorly situated.

8. An apparatus for storing and dispensing a plurality of boxes, comprising:

a first side wall;

a second side wall;

a bottom wall having a first, a second, a third and a fourth side edge, a lower edge of the first side wall secured to the first side edge, and a lower edge of the second side wall secured to the third side edge, wherein each of the first side wall, the second side wall, the bottom wall and the door comprises a respective wire grid including a plurality of vertical and horizontal segments spaced to form openings therethrough;

a door rotatably coupled to a front edge of the first side wall and latchable proximate to a front edge of the second side wall, a bottom edge of the door substantially parallel to and located at a pre-determined distance from the second side edge of the bottom wall when the door is latched, wherein the first side wall, the second side wall, the bottom wall and the door form a substantially rectangular enclosure, wherein a first end of at least one horizontal segment of the door includes a loop formed therein to rotatably capture a vertical segment defining the front edge of the first side wall, and wherein a second end of the at least one horizontal segment of the door includes a hook formed therein to latch onto a horizontal segment of the second side wall and immediately behind a vertical segment defining the front edge of the second side wall;

a first cross-member fixedly attached to a top back edge of each of the first and second side walls to position the second side wall substantially parallel to the first side wall;

a second cross-member fixedly attached to a bottom back edge of each of the first and second side walls; and wherein the first side wall, the second side wall and the bottom wall forming a substantially rectangular enclosure having a top opening and sized for receiving the plurality of boxes when the first and second cross-members are affixed to a vertical structure.

9. The apparatus of claim 4, wherein a first end of each of the plurality of horizontal segments of the bottom wall parallel to the second side edge of the bottom wall include a right angle bend configured to capture a lowermost horizontal segment of the first side wall, and wherein a second end of each of the plurality of horizontal segments of the bottom wall parallel to the second side edge of the bottom wall include a right angle bend configured to capture a lowermost segment of the second side wall.

10. The apparatus of claim 1, wherein a plurality of apertures is formed in each of the first and second cross-members, each of the plurality of apertures sized to received a bolt for attaching the first and second cross-members to the vertical structure.

11. The apparatus of claim 1, further including a mounting means for attaching the first and second cross-members to the vertical structure.

12. An apparatus for storing and dispensing a plurality of pizza boxes, comprising:

a first side wall;

a second side wall;

a bottom wall having a first, a second, a third and a fourth side edge, a lower edge of the first side wall secured to the first side edge, and a lower edge of the second side wall secured to the third side edge to position the second side wall substantially parallel to the first side wall;

a door rotatably coupled to a front edge of the first side wall and latchable proximate to a front edge of the second side wall, the door including a first end of at least one horizontal segment of the door having a loop formed to rotatably capture a vertical segment defining the front edge of the first side wall, and wherein a second end of the at least one horizontal segment of the door having a hook to latch onto a horizontal segment of the second side wall and immediately behind a vertical segment defining the front edge of the second side wall;

a first cross-member fixedly attached to a top back edge of each of the first and second side walls, and affixed to a vertical structure; and a second cross-member fixedly attached to a bottom back edge of each of the first and second side walls, and affixed to the vertical structure; and a box guide wall tiltedly positioned proximate to the fourth side edge of the bottom wall and configured to urge a lowermost pizza box of a plurality of stacked pizza boxes through a box dispensing opening, each of the first side wall, the second side wall and the bottom wall comprising a respective wire grid including a plurality of vertical and horizontal segments spaced to form openings therethrough.

13. The apparatus of claim 12, wherein the plurality of vertical segments of each of the respective wire grids is interiorly situated, and wherein the plurality of horizontal segments of each of the respective wire grids is exteriorly situated.

* * * * *